US007703509B2

(12) United States Patent
Ford

(10) Patent No.: US 7,703,509 B2
(45) Date of Patent: Apr. 27, 2010

(54) GAS ANCHOR AND SOLIDS SEPARATOR ASSEMBLY FOR USE WITH SUCKER ROD PUMP

(76) Inventor: Michael Brent Ford, 2716 Rio Vista, St. George, UT (US) 84790

( * ) Notice: Subject to any disclaimer, the term of this patent is extended or adjusted under 35 U.S.C. 154(b) by 302 days.

(21) Appl. No.: 11/681,336

(22) Filed: Mar. 2, 2007

(65) Prior Publication Data

US 2008/0210417 A1 Sep. 4, 2008

(51) Int. Cl.
*E21B 43/00* (2006.01)

(52) U.S. Cl. ..... 166/105.5; 166/265

(58) Field of Classification Search ..... 166/265, 166/105.5

See application file for complete search history.

(56) References Cited

U.S. PATENT DOCUMENTS 2,517,198 A * 8/1950 Gilbert ..... 166/105.5
3,128,719 A * 4/1964 Schmit et al. ..... 166/105.5
3,887,342 A * 6/1975 Bunnelle ..... 96/214
4,515,608 A * 5/1985 Clegg ..... 96/198
4,789,031 A * 12/1988 Walker ..... 166/369
4,977,958 A * 12/1990 Miller ..... 166/205
6,322,616 B1 * 11/2001 Kennedy et al. ..... 96/208
6,382,317 B1 * 5/2002 Cobb ..... 166/265

* cited by examiner

*Primary Examiner*—Kenneth Thompson
*Assistant Examiner*—Nicole A Coy
(74) *Attorney, Agent, or Firm*—Jeffrey Weiss; Karen J. S. Fouts; Weiss & Moy, P.C.

(57) ABSTRACT

There is provided a gas anchor for use in admitting fluids into a downhole sucker rod oil pump. The gas anchor includes an outer shell positioned around a hollow core, which defines an interior region and an exterior region of the gas anchor. The gas anchor further includes an upper region and a lower region. The hollow core and outer shell have a plurality of holes passing through the hollow core and outer shell, and the holes provide fluid communication from the exterior region to the interior region of the anchor. The hollow core and outer shell further define at least one channel which is in fluid communication from the upper region to the lower region. Additionally, the plurality of holes are formed so as to induce a cyclonic rotation on fluids passing into the interior region of the gas anchor.

3 Claims, 4 Drawing Sheets

GAS ANCHOR AND SOLIDS SEPARATOR ASSEMBLY FOR USE WITH SUCKER ROD PUMP

FIELD OF THE INVENTION

The present invention relates to mechanical oil pumps actuated by sucker rod reciprocation. More particularly, the invention relates to sand control in an oil pump and to the use of a gas anchor assembly therein.

BACKGROUND OF THE INVENTION

As the natural pressure in a completed oil well gradually depletes, the well may require a means known as artificial lift to continue the flow of petroleum reserves from their subterranean location to the earth's surface. Various forms of artificial lift are known including, for example, gas injection, water injection, and mechanical pumping. Petroleum engineers select a form of artificial lift depending on a number of criteria including, for example, formation geology and economics. The sucker rod pump is a well-known kind of mechanical pump that is widely used in the petroleum industry.

The sucker rod pumping system typically includes a means of providing a reciprocating (up and down) mechanical motion located at the surface near the well head. A string of sucker rods—up to more than a mile in length—is connected to the mechanical means. The sucker rod string is fed through the well tubing down hole where it is connected to the pump.

As is generally known in the art, a sucker rod pump includes at least two separate valves as well as other pump components such as a barrel, plunger, and anchor. Beginning at the south end, oil pumps generally include a standing valve, which has a ball therein, the purpose of which is to regulate the passage of oil (or other substance being pumped) from downhole into the pump, allowing the pumped matter to be moved northward out of the system and into the flow line, while preventing the pumped matter from dropping back southward into the hole. Oil is permitted to pass through the standing valve and into the pump by the movement of the ball off its seat, and oil is prevented from dropping back into the hole by the seating of the ball. North of the standing valve, coupled to the sucker rod, is a traveling valve. The purpose of the traveling valve is to regulate the passage of oil from within the pump northward in the direction of the flow line, while preventing the pumped oil from dropping back in the direction of the standing valve and hole.

Actual movement of the pumped substance through the system will now be discussed. Oil is pumped from a hole through a series of "downstrokes" and "upstrokes" of the oil pump, which motion is imparted by the above-ground pumping unit. During the upstroke, formation pressure causes the ball in the standing valve to move upward, allowing the oil to pass through the standing valve and into the barrel of the oil pump. This oil will be held in place between the standing valve and the traveling valve. In the traveling valve, the ball is located in the seated position, held there by the pressure from the oil that has been previously pumped.

On the downstroke, the ball in the traveling valve unseats, permitting the oil that has passed through the standing valve to pass therethrough. Also during the downstroke, the ball in the standing valve seats, preventing pumped oil from moving back down into the hole. The process repeats itself again and again, with oil essentially being moved in stages from the hole, to above the standing valve and in the oil pump, to above the traveling valve and out of the oil pump. As the oil pump fills, the oil passes through the pump and into the tubing. As the tubing is filled, the oil passes into the flow line, from which oil is taken to a storage tank or other such structure.

Presently known designs of sucker rod pumps suffer from several shortcomings in various areas of the design. The ball and seat components used in both the traveling valve and the standing valve are exposed to wear. The seat components are also subject to high pressures, particularly in deep wells, which can lead to cracking. Hence, it would be desired to develop sucker rod pumps having valves that display improved wear and cracking resistance.

A further disadvantage of presently-known sucker rod pump designs relates to sand control. Sand that is often produced along with petroleum can clog and foul pump components. Once sand enters the pump at a bottom, or southward, position, the sand must be managed in the pump apparatus. Hence, it would be desired to provide a sucker rod pump with improved sand control features. Further, it would be desired to limit sand or solids from entering the pump at the pump's lower position.

Still a further disadvantage of known sucker rods relates to the flow of petroleum and fluids through the pump. Pumps typically allow for the turbulent flow of fluids at high pressures. This turbulent flow promotes wear of pump components. It would be desired to provide a sucker rod pump with an improved flow control.

Hence there has been identified a need to provide an improved sucker rod pump and components therein. It is desired that the sucker rod pump be robust and provide an improved service life over known pumps, and thereby that the sucker rod pump provide an improved cost performance. It would further be desired that the sucker rod pump provide an improved pumping efficiency. It would also be desired that an improved sucker rod pump be compatible with existing petroleum production devices. The present invention addresses one or more of these needs.

SUMMARY OF THE INVENTION

In one embodiment, and by way of example only, there is provided a gas anchor for use in admitting fluids into a downhole sucker rod oil pump. The gas anchor includes an outer shell positioned around a hollow core, which defines an interior region and an exterior region of the gas anchor. The gas anchor further includes an upper region and a lower region. The hollow core and outer shell have a plurality of holes passing through the hollow core and outer shell, and the holes provide fluid communication from the exterior region to the interior region of the anchor. The hollow core and outer shell further define at least one channel which is in fluid communication from the upper region to the lower region. Additionally, the plurality of holes are formed so as to induce a cyclonic rotation on fluids passing into the interior region of the gas anchor.

Other independent features and advantages of the gas anchor assembly for use with a sucker rod pump will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. Reference will now be made in detail to exemplary embodiments of the invention, examples of which are illustrated in the accompanying drawings. Wherever possible, the same reference numbers will be used throughout the drawings to refer to the same or like parts.

Figure 1:
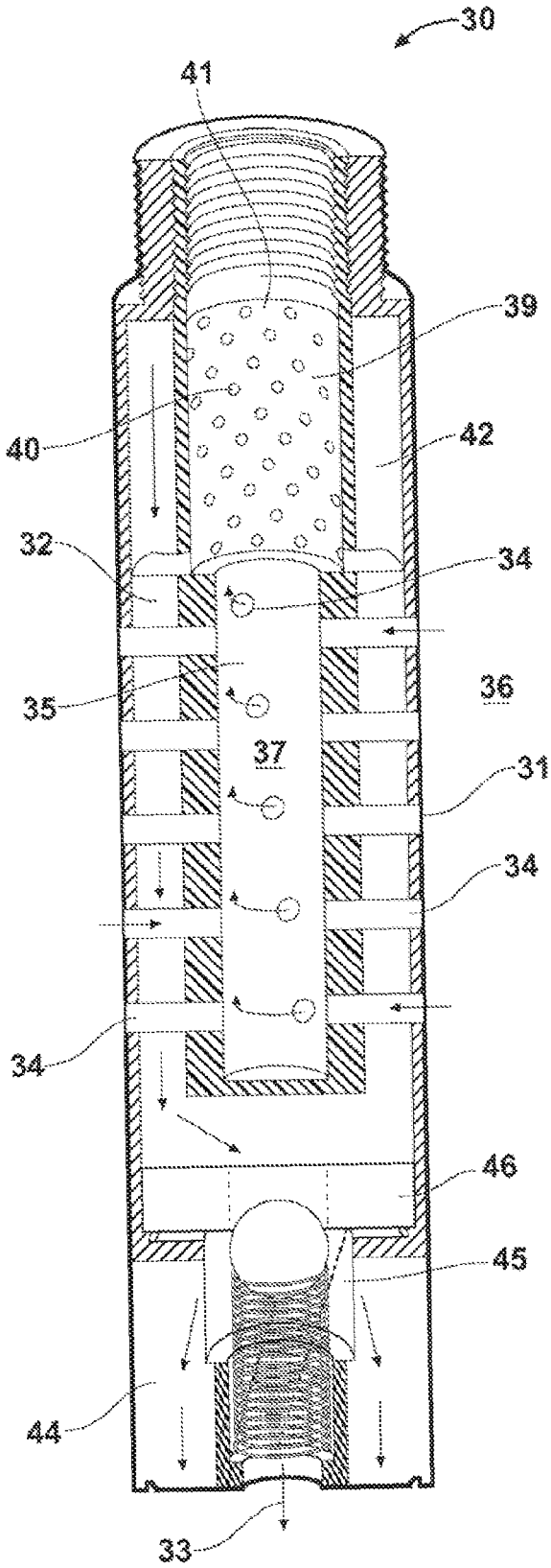
FIG. 1 is a cutaway view of a gas anchor/solids separator, according to an embodiment of the present invention.
Figure 1A:
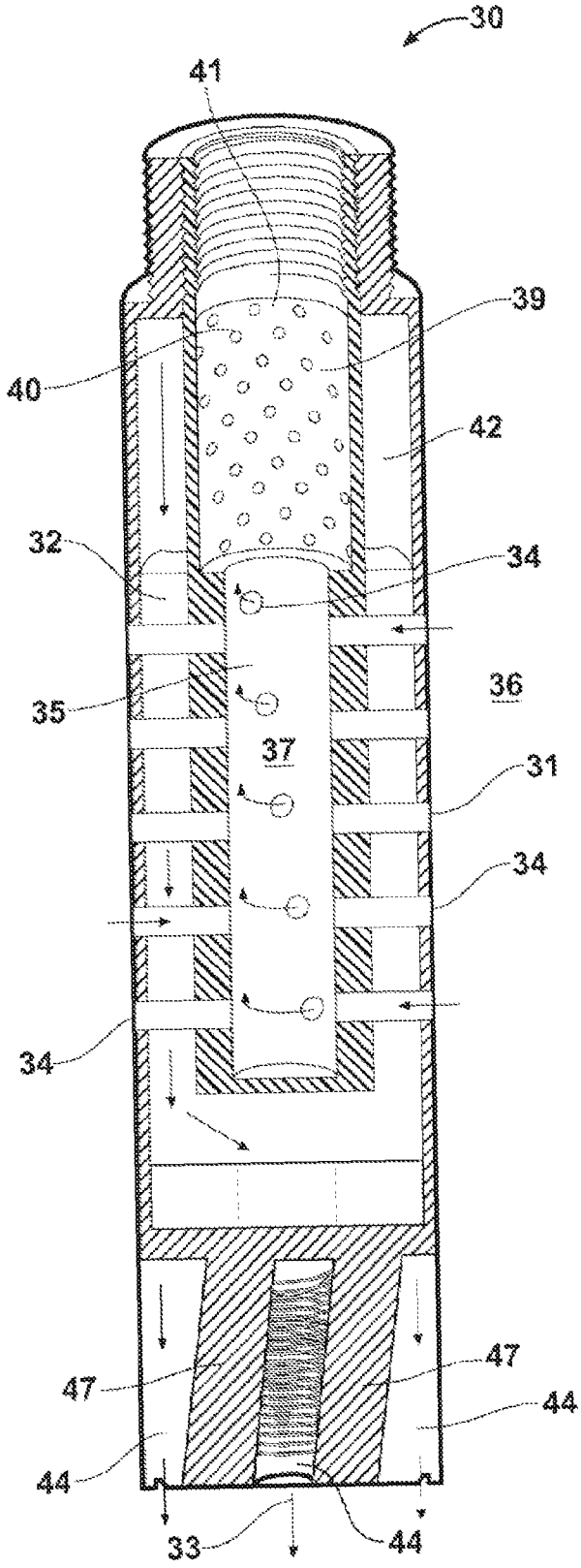
FIG. 1A is a partially cutaway view of a gas anchor/solids separator, according to an embodiment of the present invention.

Referring first to FIGS. 1 and 1A, there is illustrated a gas anchor 30 according to an embodiment of the present invention, located at the bottom of a pump section. Gas anchor 30 comprises an outer shell 31 connected to and positioned around core 32. Shell 31 separates outer region 36 from interior region 37 of the gas anchor 30. Shell 31 and core 32 are aligned along a central axis 33. Shell 31 and core 32 also define a plurality of holes 34. Holes 34 pass through both shell 31 and core 32. Core 32 further defines central chamber 35; central chamber 35 is also aligned along central axis 33. Holes 34 provide fluid communication between outer region 36 and central chamber 35. Shell 31 and core 32 are sized so that shell 31 may be positioned firmly around core 32 with substantially no movement between them. While gas anchor 30 may be formed of a unitary piece, it is preferred to form gas anchor 30 from separate pieces. In such an embodiment, shell 31 and core 32 may be joined by any of the known means such as press fitting and/or threaded assembly, by way of example only.

Figure 2:
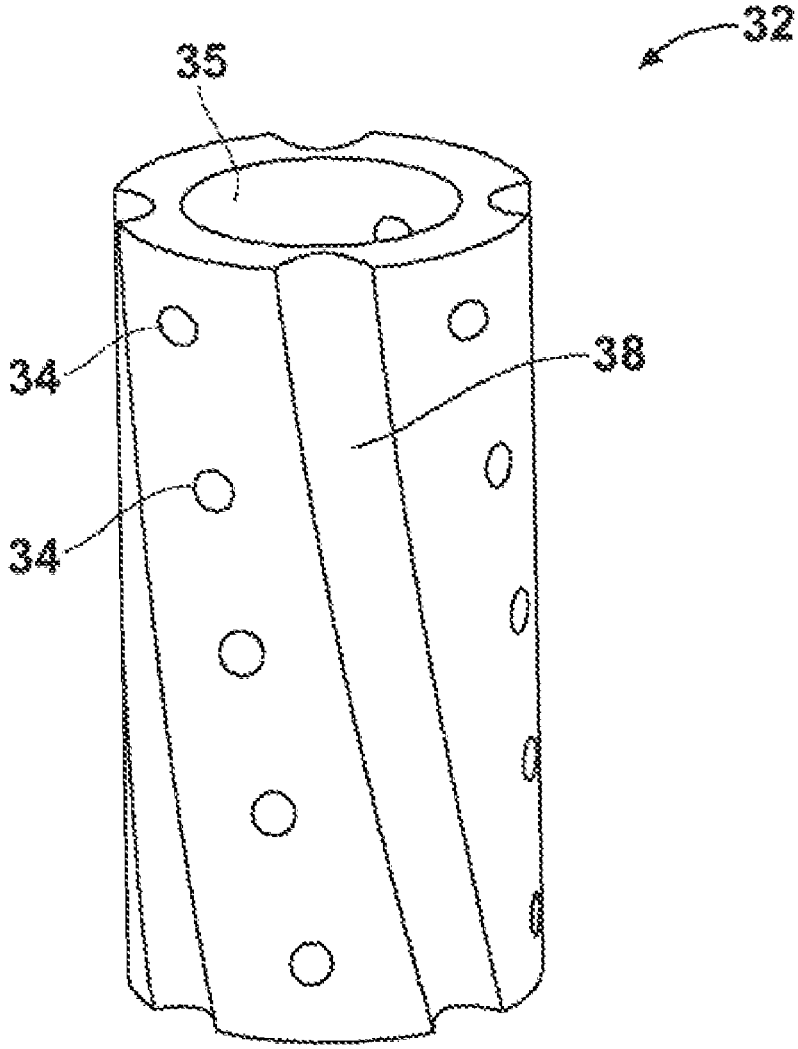
FIG. 2 is a perspective view of a core of a gas anchor/solids separator, according to an embodiment of the present invention.

Referring now to FIG. 2 there is shown a perspective view of core 32. FIG. 2 illustrates flutes 38 defined by core 32. When shell 31 is positioned around core 32, flutes 38 form a channel or passageway as explained further herein. Flutes 38 are aligned so as to provide fluid communication between the upper and lower regions of gas anchor 30 as illustrated in FIG. 1. In one embodiment, flutes 38 are aligned parallel to central axis 33 of FIGS. 1 and 1A. In a preferred embodiment, flutes 38 are arranged with a spiral configuration.

Referring again to FIGS. 1 and 1A, gas anchor 30 is shown to include screen 39 which defines screen chamber 40. Screen chamber 40 is in fluid communication with central chamber 35. Screen 39 includes openings that are sized to allow solid particles to pass out of screen chamber 40 therethrough. Screen chamber 40 is further opened at an upper end 41 to downstream portions of the pump string.

Figure 3:
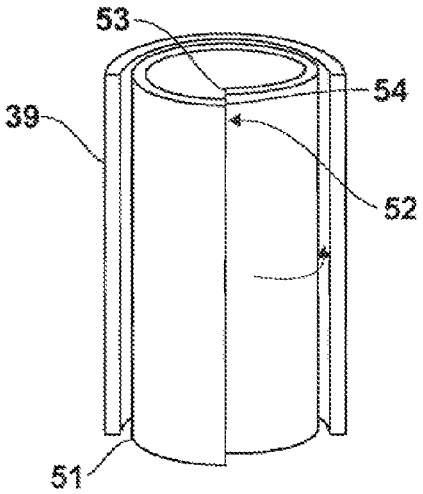
FIG. 3 is a partial cutaway view of a condenser in a screen chamber of a gas anchor/solids separator, according to an embodiment of the present invention.
Figure 4:
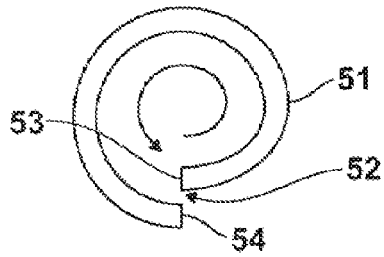
FIG. 4 is top view diagram showing rotation of fluids in a condenser, according to an embodiment of the present invention.

Referring now to FIG. 3 there is shown a further embodiment of a gas anchor 30. In this embodiment a concentrator 51 is disposed within screen 39. FIG. 4 further illustrates the preferred shape of concentrator 51 from a top view. As FIGS. 3 and 4 illustrate, concentrator 51, according to one embodiment, is a curved structure with an exit opening 52. A first end 53 and second end 54 of concentrator 51 define opening 52. As best illustrated in FIG. 4, first end 53 and second end 54 are offset. The purpose of this offset, more fully described below in the operation of the gas anchor 30 is to allow materials to pass through opening 52. Concentrator 51 may be disposed within screen chamber 40 through a variety of different means including, for example a threaded fitting. It is preferred that concentrator 51 be positioned so that it is aligned along central axis 33 and thus so that the structure of concentrator 51 is approximately set with an equal radial distance from screen 39, with the understanding that, due to differences in the radial positions of first end 53 and second end 54, concentrator will not be equally spaced in a radial direction from screen 39.

In those embodiments of gas anchor 30 that include a concentrator 51 positioned in screen chamber 40, the concentrator 51 acts to provide an additional step of solids separation. And thus, for that reason, it is desirable to include a concentrator 51 in the gas anchor assembly for use in those wells that include a relatively high degree of sand or solids in the petroleum fluids. Concentrator 51 is positioned so that fluids pass up from central chamber 35 into the inner region of concentrator 51. These fluids move with a rotational or cyclonic movement due to the motion imparted into the fluid as it passes through holes 34. Due to this cyclonic movement, sand and other materials with a heavier density move to an outer radial position. And further, the sand and other materials with a heavier density tend to exit from the inner region of concentrator 51 through exit opening 52 because exit opening is positioned at the outer diameter of concentrator. Those sand particles are then further processed by screen 39.

Referring again to FIGS. 1 and 1A, in operation of the gas anchor, petroleum fluids that may contain solids, liquids, and gases are present in outer region 36. These fluids, which may for example originate from the petroleum fluids contained in the perforated formation, enter through holes 34 on the upstroke. Holes 34 may be formed with a chosen diameter that restricts the passage of gas bubbles therethrough. Holes 34 are also positioned at an angle relative to a normal line between shell 31 and central axis 33, as discussed in more detail below with respect to FIG. 5. This alignment of holes 34 imparts a cyclonic rotation on the fluids as the fluids enter the central chamber 35. The cyclonic rotation of the fluids creates an area near the central axis 33 that moves at a lower velocity, compared with an area near an outer radial position, having a higher velocity.

Figure 5:
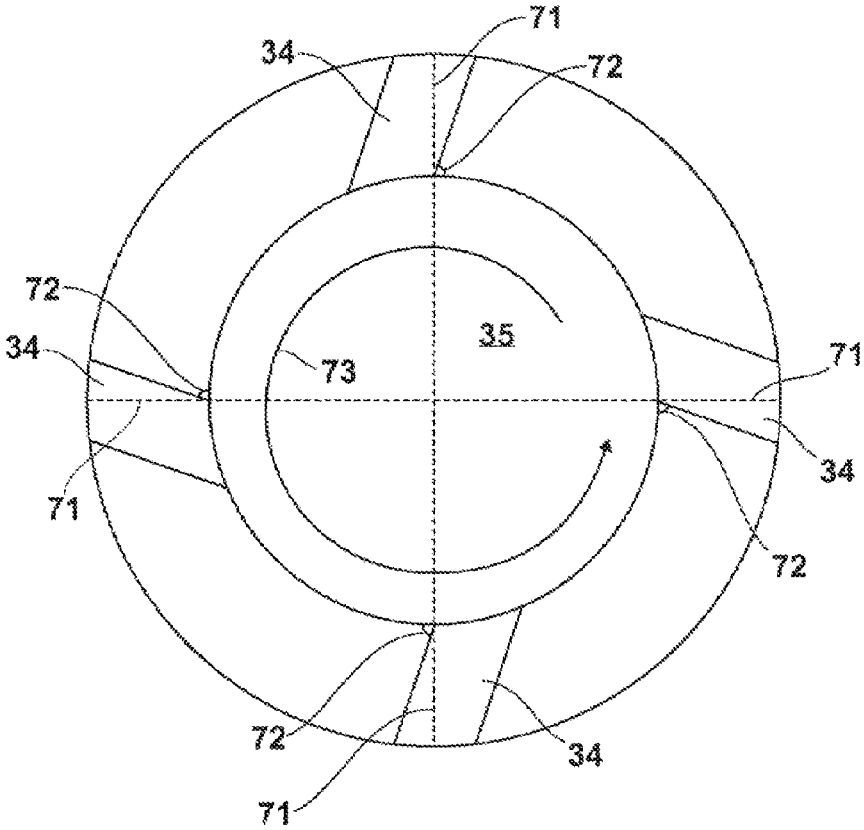
FIG. 5 is a top view of a central chamber of a gas anchor/solids separator, according to an embodiment of the present invention.

The placement and positioning of holes 34 is further represented in FIG. 5, which shows a cut away view of gas anchor 30 from a top perspective. This figure illustrates how holes 34 allow fluids to pass into central chamber 35 on the upstroke at angled directions, thus imparting cyclonic flow. As shown in FIG. 5, lines 71 represent normal lines from the center of holes 34 at the outer radial position on shell 31 extending to central axis 33. The holes 34 travel at an angle 72 relative to these normal lines 71. If desired, holes 34 may also be set at angle up or down relative to a plane normal to the central axis; however, in a preferred embodiment no such up or down alignment is created. It is further noted that, in a preferred embodiment, the alignment of each hole 34 is similarly positioned so that, upon entering center chamber 35 a rotational movement is created. This rotational movement is represented by arrow 73. In a preferred embodiment holes 34 are themselves cylindrical spaces formed by drilling; however, holes need not by cylindrical and can be curved, for example, so long as cyclonic rotation is imparted on fluids that pass through holes 34.

With respect to the cyclonic rotation of fluids, there is a differing preference for structures to be used in the northern hemisphere versus the southern hemisphere. In the northern hemisphere it is preferred that rotation be counterclockwise as viewed from above. Conversely, in the southern hemisphere it is preferred that the rotation be clockwise when viewed from above.

The bottom position of central chamber 35 restricts movement of fluids, thus, fluids are forced to escape upwardly by passing from central chamber 35 into screen chamber 40. The cyclonic motion of fluids begun in central chamber 35 continues for those fluids in screen chamber 40. Screen chamber 40 is designed so that screen 39 allows solids to exit through openings in screen 39. Solids that move through screen 39 pass from screen chamber 40 in a radially outward direction into solids capture chamber 42. Fluids that remain in screen chamber 40 continue an upward movement until passing out of top opening 41 of gas anchor 30.

Returning to the solids capture chamber 42 shown in FIGS. 1 and 1A, it is noted that solids capture chamber 42 is in fluid communication with flutes 38 (see FIG. 2). Thus solids are allowed to drop in a downward direction from solids capture chamber 42, into flutes 38, and then out of flutes 38 through bottom outlet 44 of gas anchor 30 as indicated by arrows. The movement of fluids and solids through gas anchor 30 may be assisted by the periodic pumping motion of the pump apparatus to which it is attached. It is here noted that, while a preferred embodiment of gas anchor 30 has been illustrated with four flutes 38, a different number may be provided. Similarly, while it is preferred that flutes 38 be angularly evenly spaced, this is not required.

The gas anchor may further comprise bottom outlet 44 that allows solids and/or fluids to exit from a lower region of the gas anchor. In one embodiment, bottom outlet 44 may further comprise a ball valve 45 including, for example, a springed ball valve. In such an embodiment, the spring and ball valve 45 are configured so as to permit heavy fluids to exit during an upstroke and/or downstroke of the pump. Passages at the bottom of the gas anchor allow sand, which falls to the lower region of the gas anchor, to escape to a lower position.

The ball valve 45 plays a role in admitting fluids into the gas anchor. On an upstroke, the spring forces the ball to seal against a seat 46 positioned above the ball. Thus, in order for fluid to enter the gas anchor it must do so through the holes 34. The fluid experiences suction during the upstroke so that the fluid enters the gas anchor substantially through the holes 34. On the downstroke, the ball is pushed off the seat 46 against the spring. Fluid flushes through ball valve 45 on the downstroke, expelling sand and/or other solids through radial flutes 47 (see FIG. 1A) positioned therearound, preventing the ball from sticking and allowing it to spin and clean itself during operation.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A gas anchor for use in restricting the movement of solids through a downhole oil pump, the gas anchor comprising:

a hollow core defining a central chamber;

an outer shell positioned around the hollow core, so as to define an interior region and an exterior region of the gas anchor, and so as to further define an upper region and a lower region of the gas anchor, and wherein the hollow core and outer shell are aligned along a common central axis;

wherein the hollow core and outer shell define a plurality of holes passing through the hollow core and outer shell, the holes providing fluid communication from the exterior region to the interior region and into the central chamber, and wherein substantially all of the holes passing through the hollow core and outer shell are aligned along a common angle relative to a radial line normal to the central axis, and wherein such alignment imparts a counterclockwise rotational movement on fluids entering the central chamber from the perspective of an upper region;

wherein the central chamber is closed at a lower region;

a screen positioned in the upper region relative to the central chamber and substantially aligned along the central axis, the screen defining a screen chamber, the screen chamber in fluid communication with the central chamber, wherein the screen has screen chamber openings that permit solids, contained in the fluid, to pass out of the screen chamber;

the outer shell further defining a solids capture chamber positioned around the screen chamber so as to receive solids from the screen chamber and substantially aligned along the central axis, and wherein the solids capture chamber is closed at an upper region;

wherein the hollow core and outer shell further define a plurality of flutes providing fluid communication from the solids capture chamber to the lower region; and a concentrator positioned within the screen chamber substantially aligned along the central axis.

2. The gas anchor according to claim 1 wherein the concentrator defines an exit opening with a first end positioned at a first radial position from the central axis and with a second end positioned at a second radial position from the central axis wherein the first radial position is less than the second radial position.

3. The gas anchor according to claim 2 wherein the concentrator is positioned so that solids having a rotational movement exit the concentrator through the exit opening.

* * * * *